United States Patent [19]

Todokoro

[11] 4,286,785

[45] Sep. 1, 1981

[54] TENNIS GAME BOARD

[76] Inventor: Masatoshi Todokoro, 2-33 Koganehara 2-chome, Matsudo-shi, Chiba-ken 270, Japan

[21] Appl. No.: 158,471

[22] Filed: Jun. 11, 1980

[30] Foreign Application Priority Data

| | | | |
|---|---|---|---|
| Aug. 16, 1979 | [JP] | Japan | 54/112569[U] |
| Aug. 16, 1979 | [JP] | Japan | 54/112570[U] |
| Aug. 16, 1979 | [JP] | Japan | 54/112571[U] |
| Aug. 16, 1979 | [JP] | Japan | 54/112572[U] |

[51] Int. Cl.[3] ..... A63F 7/06

[52] U.S. Cl. ..... 273/85 D; 273/127 D; 273/129 V; 273/26; 273/119 R

[58] Field of Search ..... 273/85 D, 85 C, 85 F, 273/85 R, 26, 127 D, 129 V

[56] References Cited

U.S. PATENT DOCUMENTS

| | | | |
|---|---|---|---|
| 3,995,859 | 12/1976 | Goldfarb et al. | 273/85 F |
| 4,042,239 | 8/1977 | Cecchetti | 273/85 D |

*Primary Examiner*—George J. Marlo

*Attorney, Agent, or Firm*—George B. Oujevolk

[57] ABSTRACT

This invention relates to a game board whereby a mimic tennis game can be played. Two animated racket-supporting bodies disposed opposedly to each other across a play board are moved alternately so as to catch a ball which comes rolling on the board surface toward either side of the board where said racket-supporting body is disposed, and when the racket carried by the racket-supporting body on one side catches the ball and the racket is accordingly displaced, the racket driving mechanism provided in the racket-supporting body is operated to drive the racket so that it will automatically hit the ball. After hitting of the ball by the racket, the racket driving mechanism is inactivated. As the animated bodies are moved across the play board, a pinion gear meshes with a rack gear and ultimately a spring is wound up to accumulate power for driving the simulated tennis ball. Each time a ball is hit, a bell rings. The tennis racket carried by each animated body is actuated by a spring driven mechanism including a cam plate formed with a curved groove and a follower connected to the cam plate. A half spherical member is slidable in a slot marked with numerical figures to provide a score indicator.

13 Claims, 21 Drawing Figures

TENNIS GAME BOARD

OBJECTS OF THE INVENTION

An object of this invention is to provide an enjoyable mimic tennis game board in which two animated racket-supporting bodies are provided opposedly to each other across a play board, said bodies being moved alternately toward a ball which comes rolling on the board, and when the racket carried by a racket-supporting body catches the ball, said racket is automatically activated to hit the ball.

Another object of this invention is to provide a mimic tennis game board according to which while any of the racket-supporting bodies is being moved, the racket driving mechanism is kept inoperative and the spring for giving driving power to said racket driving mechanism is automatically wound up within the limit of its winding capacity to accumulate the driving power, thereby allowing continuous play of the game.

Still another object of this invention is to provide a mimic tennis game board designed such that the ball hitting force of the racket can be adjusted by operating a lever projecting out from each racket-supporting body.

Yet another object of this invention is to provide a mimic tennis game board of the recited type, in which the bell rings when the racket hits the ball.

BRIEF DESCRIPTION OF THE DRAWING

FIG. 1 is a plane view of the game board,

FIG. 2 is a side view thereof, with parts shown in section,

FIG. 3 is an enlarged side elevational view, with parts shown in section, of the driving mechanism for the racket-supporting body, FIG. 4 is a side elevational view as taken from the right-hand side of FIG. 3, with parts shown in section, FIG. 5 is a plane view of FIG. 3, FIG. 6 is a bottom view of FIG. 5, FIG. 7 is an enlarged frontal view of a cam plate, FIG. 8 is a left-side view of FIG. 7, FIG. 9 is an enlarged frontal view of a follower, FIG. 10 is a left-side view of FIG. 9, FIG. 11 is a back side view showing a condition where the follower of FIG. 9 was coupled to the cam plate, and FIGS. 12 to 15 illustrate the process of movements of said cam plate and follower;

FIG. 16 is a side view thereof, with parts shown in section,

FIG. 17 is an enlarged side elevational view, with parts shown in section, of the driving mechanism for the racket-supporting body, and FIG. 18 is a side elevational view as taken from the right-hand side of FIG. 17, with parts shown in section; FIG. 19 is a plane view, FIG. 20 is a sectional view taken along the line I—I of FIG. 19, and FIG. 21 is a sectional view taken along the line II—II of FIG. 19.

DETAILED DESCRIPTION OF THE PREFERRED EMBODIMENTS

An embodiment of this invention is now described in detail with reference to FIGS. 1 to 15 of the accompanying drawings.

Figure 1:
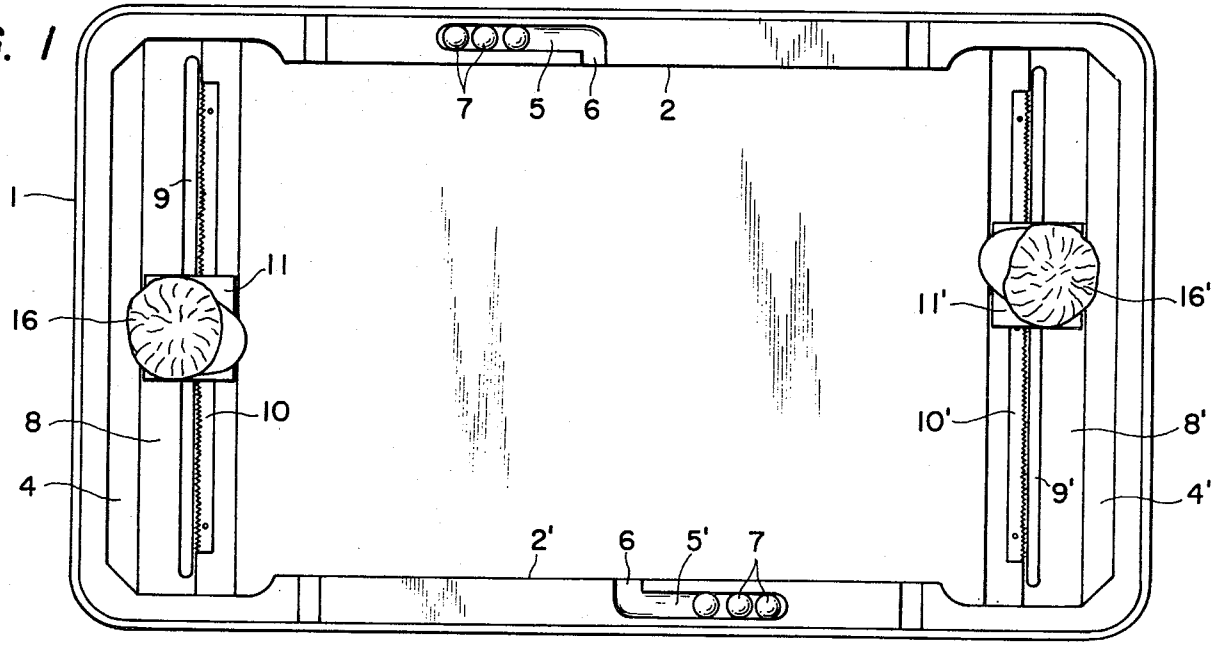
FIGS. 1 to 15 show an embodiment of this invention, where
Figure 2:
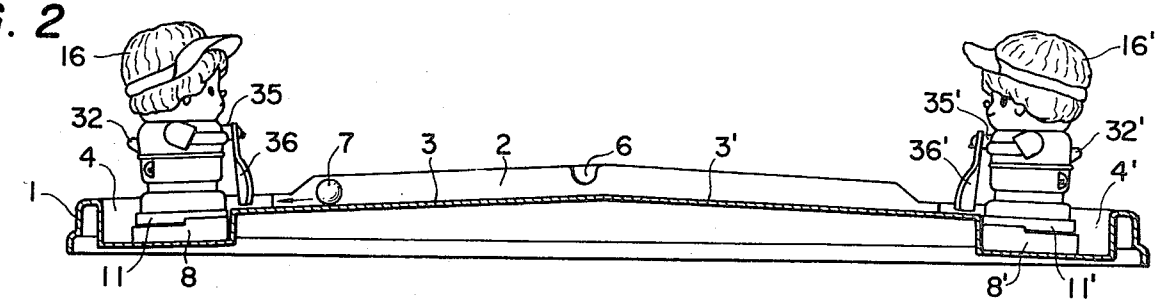
Figure 3:
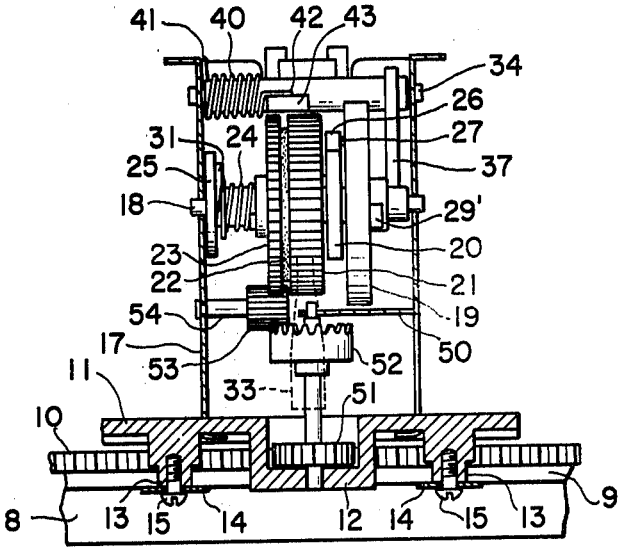
Figure 4:
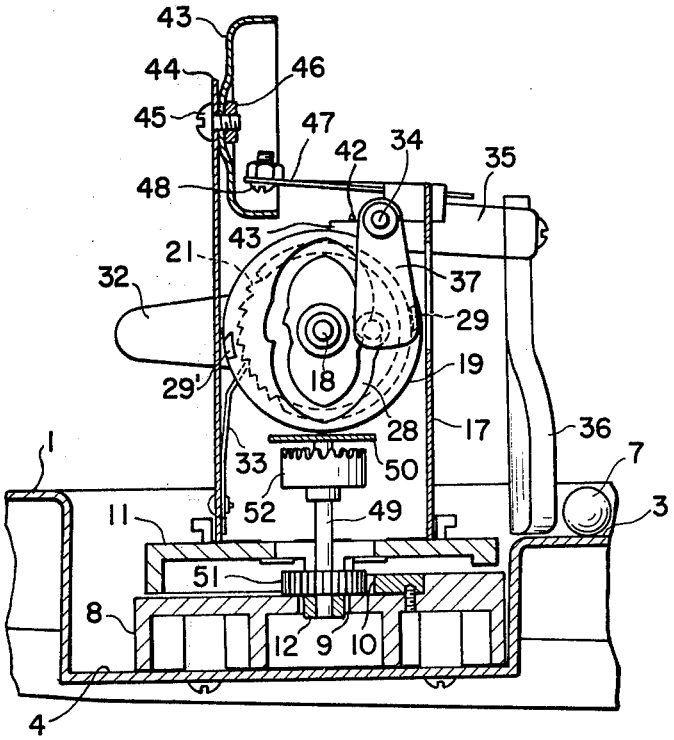
Figure 5:
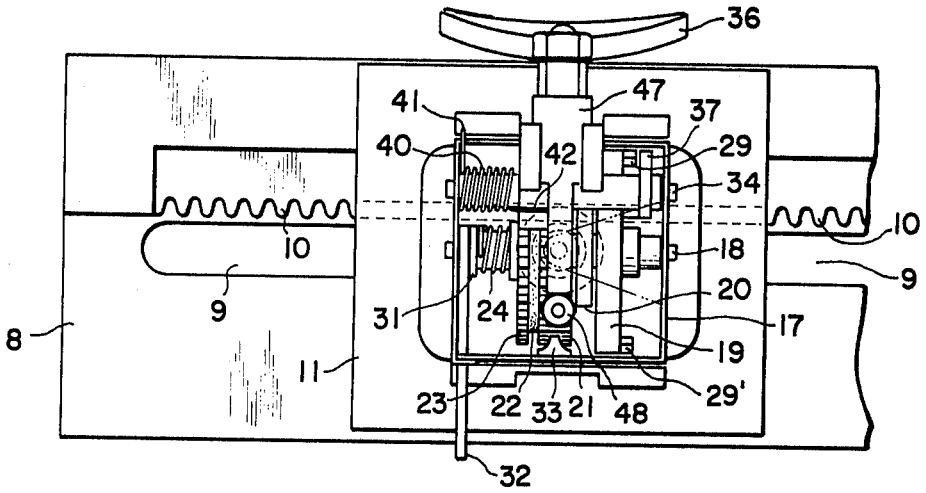
Figure 6:
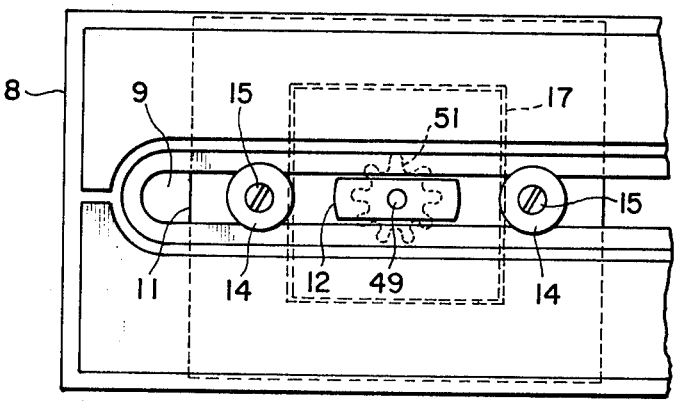
Figure 8:
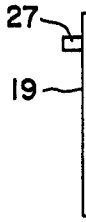
Figure 7:
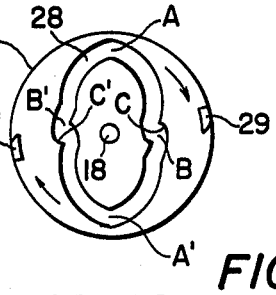
Figure 9:
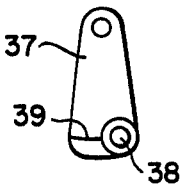
Figure 10:
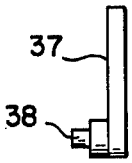
Figure 11:
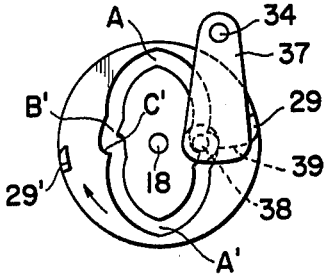
Figure 12:
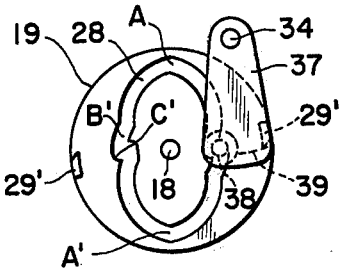
Figure 13:
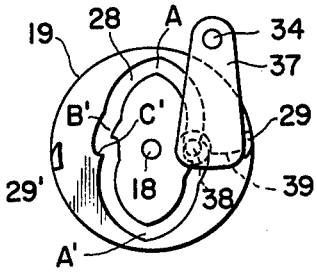

In the drawings, numeral 1 indicates a rectangular base board having the fencing walls 2, 2' along the opposing longer sides of the board. The board surface slopes up gently toward the center line connecting the middle points of said respective fencing walls 2, 2', thus forming the slanting surfaces 3, 3'. It will be also seen that a recession 4 (4') is formed in the section defined by the edge of each said slanting surface 3 (3') and the associated shorter side of the board 1. Each of said fencing walls 2, 2' is provided with a ball gutter 5 (5') where the balls 7 are placed in a row so that they may be let out one by one from the outlet 6 onto the board surface near the elevated center region. Secured to the bottom of each said recession 4 (4') is a floor plate 8 (8') formed with an elongated slot 9 (9') extending parallel to the shorter side of the board 1. A rack gear 10 (10') is secured to a top part of each said floor plate 8 (8') such that said rack gear extends along an edge of the associated elongated slot 9 (9'). A block 11 (11') is mounted on each said floor plate 8 (8') so that it is movable reciprocatively along the corresponding slot 9 (9'). Each said block 11 (11'), as shown in FIG. 3, is provided with a block supporting portion 12 which is U-sectioned in the longitudinal direction, opened at both ends in the transverse direction and fitted slidably in the slot 9 (9'), and the protuberances 13, 13 disposed on both sides of said supporting portion 12 are also fitted slidably in the slot 9 (9'). At the end of each said protuberance 13 is secured a washer 14 having a greater diameter than the width of said slot 9 (9'), and a screw 15 is passed into said protuberance 13 through said washer 14 to thereby secure the block 11 against removal from the slot 9. Erected on each said block 11 (11') is an animated hollow racket-supporting body 16. The two animated bodies 16, 16' are so disposed as to oppose to each other across the play board.

Numeral 17 refers to a frame secured on each said block 11 (11') in the inside of each racket-supporting body 16 (16'). Supported by said frame 17 at its middle part is a main shaft 18 which is passed centrally through a lineup of operational members comprising a cam plate 19, a windup spring 20, a ratchet wheel 21, a rubber-made friction plate 22, a gear 23, a pressing spring 24 and a pressing force adjusting plate 25. Of these members, the ratchet wheel 21 alone is fixed to the main shaft 18 so as to turn therewith, and the cam plate 19, friction plate 22, gear 23 and pressing force adjusting plate 25 are so mounted as to be freely rotatable. The outer end 26 of the windup spring 20 is secured to a protuberance 27 disposed close to a peripheral part of the cam plate 19 while the inner end of said spring 20 is secured to a protuberance (not shown) disposed close to the central part of the ratchet wheel 21. The cam plate 19 is provided, on its side opposite from the windup spring 20, with a cam groove 28 connecting a pair of longer-diameter positions A, A' and a pair of shorter-diameter positions B, B' alternately at an angular distance of 90 degrees. At each of the shorter-diameter positions B, B' of said cam groove 28 is provided a stepped portion C (C') designed to change the direction of the groove such that, as viewed in the rotating direction of the cam plate 19 indicated by arrows, the upper side of the groove at the position B (B') will curve outwardly and the lower side will curve inwardly. At the circumferential periphery of said cam plate 19 are provided the stopper pieces 29, 29' disposed at the slightly lower side positions (in the rotating direction of the cam plate) from the line connecting the shorter-diameter positions B, B' of the cam groove 28. The pressing force adjusting plate 25 is tapered on its side opposed to the pressing spring 24 and is also provided with an arcuate protuberance 31 centered by the main shaft 18. An end of the pressing spring 24 is pressed against said protuberance 31 while the other end of said spring 24 is pressed against a side of the gear 23. Secured to said pressing force adjusting plate 25 is an operating lever 32 (32') which is passed through the frame 17 and the racket-supporting body 16 to project out from the backside of said body. Numeral 33 denotes a pawl plate which is secured at its proximal end to a part of the frame 17 opposed to the ratchet wheel 21 while the distal end of said pawl plate 33 is pressed against the notched face of the ratchet wheel 21 so that when the ratchet wheel 21 turns in the same direction as the rotating direction of the cam plate 19 indicated by arrows, the distal end of said pawl plate 33 slides while pressedly contacting with the teeth of the ratchet wheel 21, thus allowing rotation of the ratchet wheel 21, but when the ratchet 21 is urged to turn in the opposite direction, the distal end of said pawl plate 33 is engaged with a tooth of the ratchet wheel 21 to inhibit rotation of the ratchet wheel 21. Mounted at an elevated position across the frame 17 is a racket driving shaft 34 extending parallel to the main shaft 18. Secured to and extending from a middle part of said racket driving shaft 34 is a bar 35 (35') which is passed through the frame 17 and the racket-supporting body 16 (16') to project out from the front side of said body 16 (16'), and a racket 36 (36') is secured to the projecting end of said bar 35 (35') such that said racket pends down therefrom. To an end of said shaft 34 positioned close to the cam plate 19 is secured an end of a follower 37 which is provided at its other end with a protuberance 38 designed to slidably fit into the cam groove 28 and a raised-up portion 39 against which the stopper piece 29 (29') abuts to stop the turning motion of the cam plate 19 with said protuberance 38 being engaged in the stepped portion C (C') of the cam groove 28. Said shaft 34 is also loaded with a spring 40 disposed between the joint with the bar 35 and the end of the shaft 34 opposite from its end mounted with the follower 37. An end 41 of said spring 40 is secured to the frame 17 while the other end 42 is secured to a protuberance 43 provided at a middle part of the driving shaft 34, whereby said driving shaft 34 is elastically supported so that the racket 36 will always maintain its vertical position. Designated by numeral 43 is a bell which is secured by means of a screw 45 and a nut 46 to the inside of an upwardly extended portion 44 of the frame member on the side opposite from the frame member through which the bar 35 is passed. There is also provided a leaf spring 47 of which one end is secured to the upper side of the bar 35 and the other end is positioned close to the bell 43. At the end of the leaf spring 47 positioned close to the bell 43 is provided a protuberance 48 designed to strike the bell 43. Numeral 49 refers to a vertical shaft disposed between the bottom of the block supporting portion 12 and a cut and raised up piece 50 formed by cutting and bending up vertically toward the inside of the frame 17 a part of the frame member positioned slighly lower than the cam plate 19. At the lower end of said vertical shaft 49 is secured a pinion gear 51 having a diameter allowing projection of the gear through the openings at both ends of the block supporting portion 12 and meshed with the rack gear 10, and a crown gear 52 is secured to the top end of said vertical shaft 49. 53 is a transmission gear meshed with said crown gear 52 and the gear 23 mounted on the main shaft 18, said transmission gear 53 being rotatably mounted on a shaft 54 secured to the frame 17.

The mimic tennis game board having the above-described mechanism is now described from its operational aspect. When the player moves his animated racket-supporting body 16 (16') reciprocatively along the elongated slot 9 (9') by holding said body with his hand, the pinion gear 51 meshed with the rack gear 10 (10') is urged to turn correspondingly, and this reciprocative turning motion is transmitted through the vertical shaft 49, crown gear 52 and transmission gear 53 to the gear 23. Said gear 23 is pressed against the fraction disc 22 by the compressed spring 24 and said fraction disc 22 is in turn pressed against the opposing side of the ratchet wheel 21, so that when said gear 23 turns in the same direction as the rotating direction of the cam plate 19 indicated by arrows, that is, when said gear 23 turns forwardly, the ratchet wheel 21 is allowed to turn correspondingly without being checked by the pawl plate 33. Accordingly, the inner end of the windup spring 20 is wound up, and since the outer end 26 thereof is secured to a fixed position by the protuberance 27 on the cam plate 19 which is locked against movement as one of the stepped portions C or C' of the cam groove 28 abuts against the protuberance 38 of the link 37 and also one the stopper pieces 29 or 29' abuts against the end of the protuberance 39, the windup spring 20 is thus wound up to accumulate the rotative power. When the gear 23 turns reversely after said forward rotation, the pawl plate 33 is engaged with the ratchet wheel 21 to lock its movement, keeping the windup spring 20 in said wound up state.

In this way, the spring 20 is wound up progressively by every forward turn of the gear 23, and when the spring is wound up to its limit capacity, the spring force overwhelms the frictional force of the friction disc 22, allowing the ratchet wheel 21 and gear 23 to begin sliding over the friction disc 22, so that no matter how much the gear 23 turns forwardly thereafter, the spring 20 won't be wound up any more and thus over-winding of the spring 20 is prevented.

Figure 14:
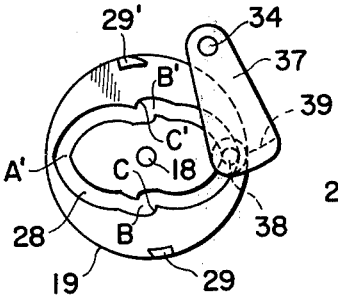
Figure 15:
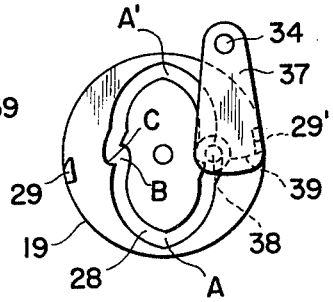
Figure 16:
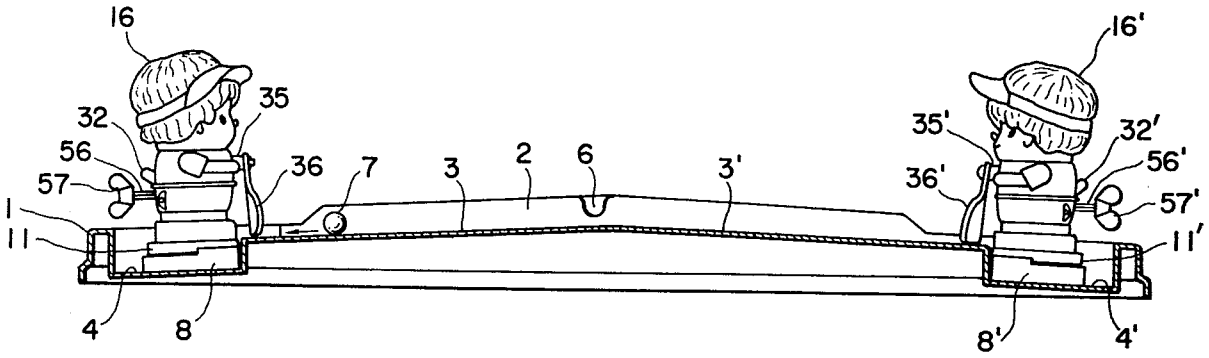
FIGS. 16 to 18 show another embodiment of this invention, where
Figure 17:
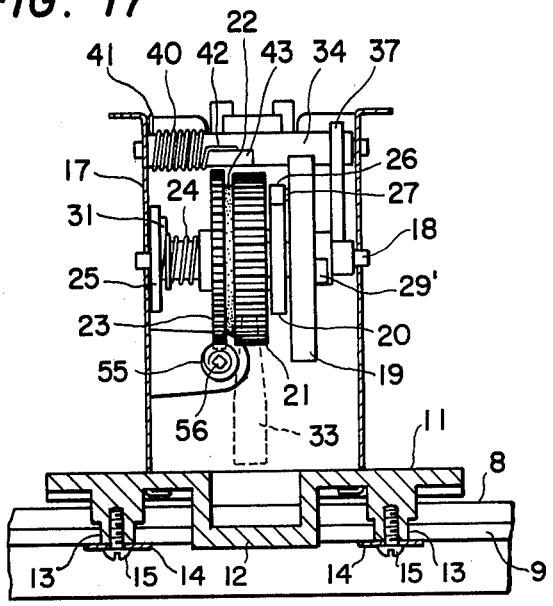
Figure 18:
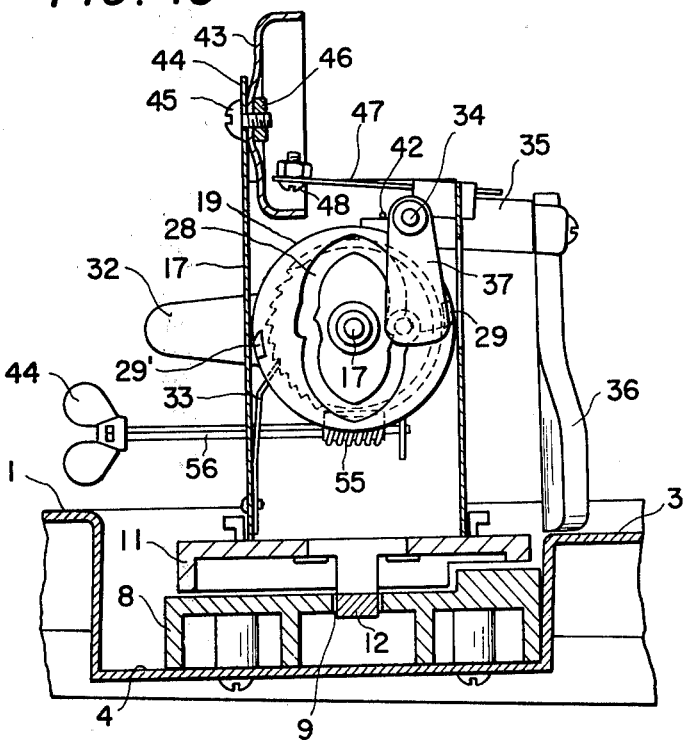

Under this condition, a ball 7 is brought onto the central part of the surface of the play board 1 from either of the ball gutters 5 or 5', for example from the ball gutter 5. As the ball 7 rolls down on the slant surface 3 toward the recession 4, the player moves his racket-supporting body 16 toward the ball 7 so as to catch the ball with the racket 36. When the racket 36 catches the ball 7, the lower end of the racket 36 is pushed by the force of the ball 7, causing the end of the bar 35 to lower down while propped by the driving shaft 34, whereupon said shaft 34 turns its follower 37 from the position of FIG. 12 to the position of FIG. 13 where the protuberance 38 is disengaged from the stepped portion C of the cam groove 28 against which said protuberance has been pressed under the elastic force of the spring 40 and also the end of the protuberance 39 is disengaged from the stopper piece 29. Consequently, the rotative force accumulated on the windup spring 20 is now exerted to the cam plate 19 to let it turn quickly in the direction of arrow, causing corresponding turn of the cam groove 28 about the main shaft 18, and in the course of movement of the protuberance 38 from the shorter-diameter position B of the cam groove 28 to the longer-diameter position A as shown in FIG. 14, the end of the follower 37 is pushed out sharply and its movement is transmitted through the driving shaft 34 and projecting bar 35 to the racket 36 to let it strike the ball 7. And in the course of movement of the protuberance 38 from said longer-diameter position A to the shorter-diameter position B' on the opposite side as shown in FIG. 15, the end of the follower 37 is pushed back to its original position and its movement is transmitted through the driving shaft 34 and projecting bar 35 to the racket 36 to let it return to its original position. When the racket 36 assumes its original position and the cam plate 15 makes a half-turn from its starting position, the stopper piece 29' on the opposite side abuts against the end of the protuberance 39 as shown in FIG. 15, thus locking the cam plate 19 against movement and creating a situation ready for striking the next rolling-down ball 7. When the ball 7 is hit by the racket 36 during its actuation, the turning motion of the driving shaft 34 is transmitted to the leaf spring 47 so that its ball-striking portion 48 strikes the bell 43 to let go bell ringing upon hitting of the ball.

The ball 7 hit by the racket 36 rolls up on the slant surface 3, and after passing the peak point, it further rolls down on the slant surface 3' on the opposite side toward the recession 4', so that the player on the opposite side moves his racket-supporting body 16' so as to catch the ball 7 with the racket 36'. The racket 36' is actuated in the same way as said above to hit the ball 7, and the hit ball rolls up on the slant surface 3', and after passing the highest point, it further rolls down on the slant surface 3 toward the recession 4. So, the player on this side again moves his racket-supporting body 16 so as to catch the ball 7 with the racket 36. As the racket 36 catches the ball 7, the end of said racket 36 is pushed by the force of the ball 7 to let the end of the bar 35 lower down while propped by the driving shaft 34, whereby said shaft 34 is actuated to turn the follower 37 from the position of FIG. 15 to the position where the protuberance 38 is dislocated from the stepped portion C' of the cam groove 28 while the end of the protuberance 39 is disengaged from the stopper piece 29'. Consequently, the rotative force accumulated on the windup spring 20 is exerted to the cam plate 19 to let it turn quickly in the direction of arrow, causing corresponding turn of the cam groove 28, and in the course of movement of the protuberance 38 from the shorter-diameter position B' of the cam groove 28 to the longer-diameter position A', the end of the follower 37 is pushed out sharply and thereby the racket 36 is actuated in the manner described above to hit back the ball 7, and in the course of further movement of the protuberance 38 from said longer-diameter position A' to the original shorter-diameter position B, the racket 36 is driven in the same way as said above to return to its original position. When the racket 36 thus assumes its original position and the cam plate 19 makes the additional half turn, the first stepped portion C is engaged with the protuberance 38 and the stopper piece 29 abuts against the end of the protuberance 39 to lock the cam plate 19, thereby producing a stand-by situation for striking the next rolling-down ball 7.

If the racket-supporting body 16 (16') is moved reciprocatively along the elongated slot 9 (9') before the ball comes rolling down again, the loosened spring 20 is wound up upon every forward turn of the gear 23 and always maintained in a maximal wound-up condition, thus keeping the rotative power accumulated constantly. In this case, if the pressing force adjusting plate 25 is turned by operating the lever 32 (32') projecting out from the back side of the racket-supporting body 16 (16') so that the raised-up side of the protuberance 31 will be pressed against the pressing spring 24 to strengthen the spring pressure, the spring 20 is wound up faster and stronger, allowing striking of the ball with a stronger force. On the other hand, if the pressing force adjusting plate 25 is turned so that the recessed part of the protuberance 31 will be pressed against the pressing spring 24 to weaken the spring pressure, the spring 20 is wound up more slowly and more weakly, so that the ball 7 is striken with a weaker force.

In this way, two players move their racket-supporting bodies 16, 16' alternately to hit the ball 7 with the racket 36 to return the ball to the player on the opposite side. If any player fails to hit the ball, he allows one point to his opponent. By repeating the above-said operation, two players can continue a mimic tennis game.

The present invention is not limited to the foregoing embodiment but includes the following modifications.

For instance, the rack gear 10, vertical shaft 49, cut and bent up piece 50, pinion gear 51, crown gear 52, transmission gear 53 and shaft 54 in the mechanism of the above-described embodiment may be eliminated, and instead the main shaft 18 may be extended so that it projects out from the racket-supporting body 16 (16'), with a turning grip being fixed to the extended end, or a winding shaft 56 (56') may be provided in the frame 17, said shaft 56 (56') carrying at its end a worm gear 55 meshed with the gear 23 and having its other end projected out from the back side of the racket-supporting body 16 (16'), with a butterfly grip 57 (57') being secured to the other end of said shaft 56 (56').

When one holds and turns said grip 57 (57') and hence the winding shaft 56 secured thereto to let the gear 23 turn in the same direction as the rotating direction of the ratchet wheel 21, said turning motion of the shaft 56 is transmitted to the ratchet wheel 21 as the gear 23 is pressed against the friction disc 22 by the pressing force of the spring 24 and the friction disc 22 is thereby pressed against a side of the ratchet wheel 21. Accordingly, the inner end of the windup spring 20 is wound up, and since the outer end 26 thereof is secured to a fixed position by the protuberance 27 of the cam plate 19 which is kept stationary by the engagement of the protuberance 38 of the link 37 in one of the stepped portions C or C' in the cam groove 28 and by the abutment of one of the stopper pieces 29 or 29' against the end of the protuberance 39, the spring 20 is wound up to accumulate the rotative force. The grip 57 (57') cannot be turned reversely since the pawl plate 33 is engaged with the ratchet wheel 21 to inhibit its rotation in the reverse direction.

In this embodiment of the invention, the spring 20 is gradually unwound as alternate hitting of the ball 7 by the rackets 36, 36' is continued. In this case, the game may be continued until the spring 20 runs down perfectly, or the spring 20 may be wound up properly while continuing the game.

Figure 19:
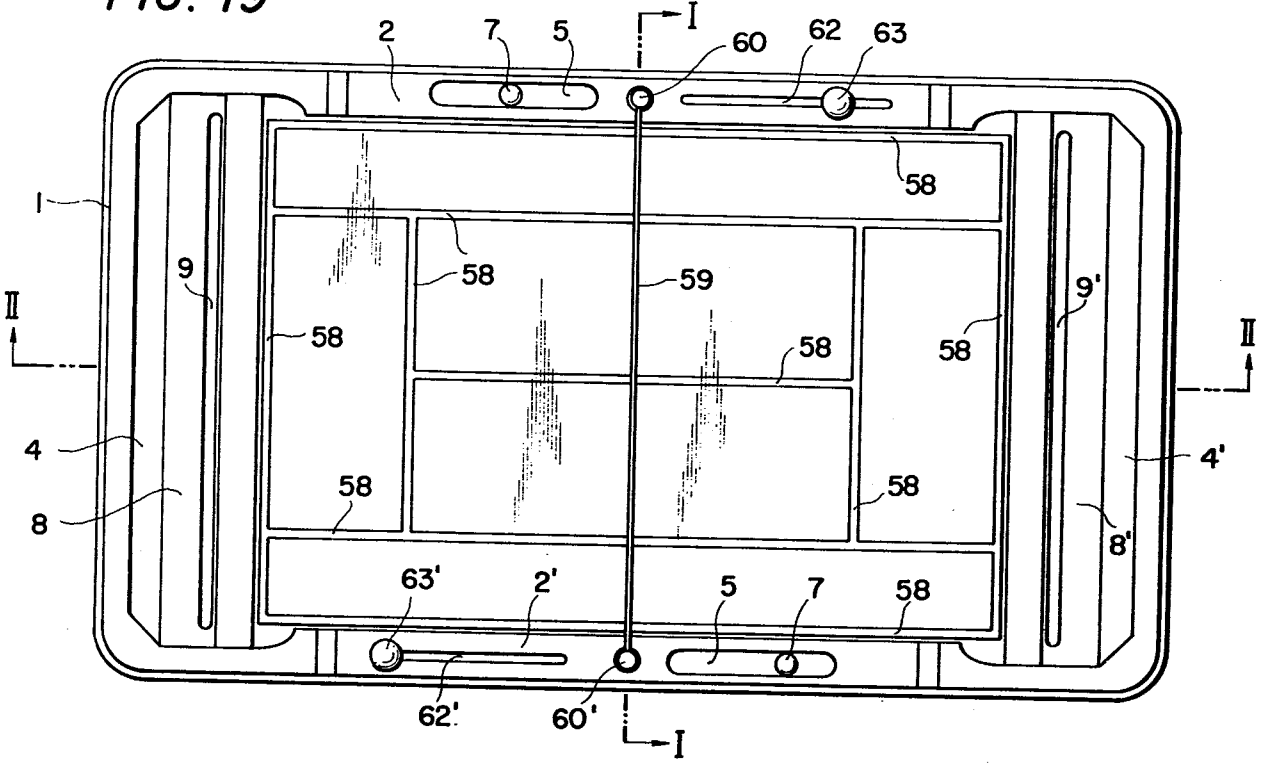
FIGS. 19 to 21 show a modification of the play board, where

Lines 58 may be directly drawn on the surface of the board 1 to present an actual tennis court lining as shown in FIG. 19, or a mat described with such lines 58 may be pasted to the board surface.

Figure 20:
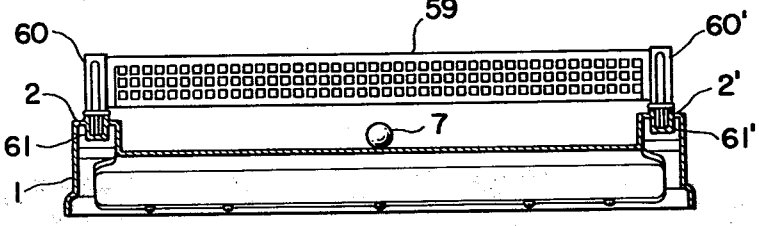
Figure 21:
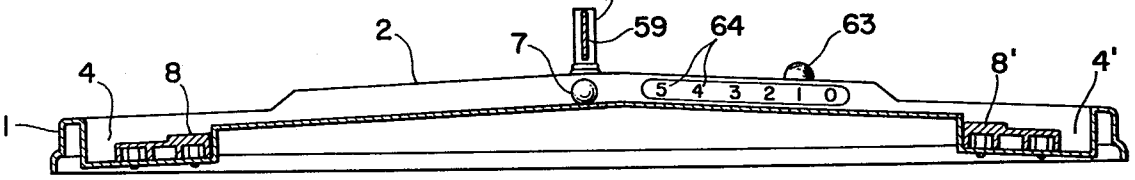

A net plate 59 resembling an actual tennis net may be set centrally across the fencing walls 2, 2' provided on the board 1 as shown in FIGS. 19 to 21. In this case, the support posts 60, 60' provided at both ends of the net plate 59 are so designed that their lower end portions may be detachably fitted into the corresponding holes 61, 61' formed in the top surfaces of the fencing walls 2, 2', with the lower edge of the net plate 59 being sufficiently spaced-apart from the board surface to allow passage of the ball 7 therethrough.

Also, a half-spherical score indicator 63 (63') may be slidably set in an elongated slot 62 (62') formed in the top surface of each fencing wall 2 (2'), and a series of numerical figures 64 for expressing the score may be directly inscribed on the inner side of each fencing wall 2 (2') or a strip of paper bearing such figures 64 may be pasted thereto.

What is claimed is:

1. A tennis game board mounted with the animated racket-supporting bodies disposed opposedly to each other across the board surface, each of said racket-supporting bodies having provided therein a main shaft and a racket driving shaft to which a racket is secured, said main shaft having mounted thereon a cam plate formed with a curved groove designed to convey to said racket a movement for striking a ball rolling down on the board surface and a windup spring adapted to transmit rotative force to said main shaft, said racket driving shaft having joined thereto an end of a follower whose other end is connected to said cam plate.

2. The tennis game board according to claim 1, wherein the follower is provided with a protuberance designed such that during the time when the ball stays away from the racket, a stopper piece on the cam plate abuts against said protuberance to inhibit turn of the cam plate, and when the ball hits on the racket to let it displace, said protuberance is accordingly displaced to a position where it is disengaged from said stopper piece.

3. The tennis game board according to claim 2, wherein the cam plate is provided with a cam groove connecting to a pair of longer-diameter positions and a pair of shorter-diameter positions alternately at angular interval of 90 degrees, said cam groove having provided at each of said shorter-diameter positions thereof a stepped portion designed to change the direction of the groove such that, as viewed in the rotating direction of the cam plate, the upper side will be curved outwardly and the lower side will be curved inwardly, and there are also provided a pair of stopper pieces at the periphery of the cam plate, said stopper pieces being positioned on the slightly lower side, as viewed in the rotating direction of the cam plate, from the line connecting said shorter-diameter positions of the cam groove.

4. The tennis game board according to claim 1, wherein a rack gear is provided along the area of movement of each racket-supporting body which has provided therein the main shaft mounted with gears through a clutch mechanism adapted to rotate said gears in one direction alone, each said racket-supporting body also having provided therein a shaft supporting a pinion gear meshed with said rack gear, said shaft being mounted with a transmission gear arranged to be meshed with said gears through or without intermediate gear.

5. The tennis game board according to claim 4, wherein the clutch mechanism comprises a ratchet wheel secured to said main shaft provided in each said racket-supporting body and a pawl plate of which the distal end abuts against said ratchet wheel and the proximal end is secured to a fixed position in the racket-supporting body.

6. The tennis game board according to claim 5, wherein each said main shaft has freely rotatably mounted thereon a friction disc adjoining to said ratchet wheel and a gear adjoining to said friction disc and meshed wth the transmission gear mounted on the supporting shaft of the pinion gear meshed with said rack gear, said main shaft being also mounted with a pressing force adjusting plate disposed at a position spaced-apart from said gears and having a tapered arcuate raised-up portion centered by the main shaft and provided with a lever which projects out from the racket-supporting body, and a pressing spring is interposed between said arcuate raised-up portion and said gears.

7. The tennis game board according to claim 1, wherein the main shaft provided in each racket-supporting body is provided with a clutch mechanism adapted to rotate said main shaft in one direction alone, said main shaft being extended so that it projects out from the racket-supporting body, with a turning grip being secured to the end of the projecting portion of the main shaft.

8. The tennis game board according to claim 7, wherein a winding shaft is provided in each racket-supporting body, said winding shaft carrying at its one end a gear or worm gear meshed with the gears on the main shaft, the other end of said winding shaft extending out from the racket-supporting body, with a turning grip being secured to the end of the extended-out portion of said winding shaft.

9. The tennis game board according to claim 1, wherein a leaf spring is provided in each racket-supporting body, said leaf spring being secured at its one end to the racket driving shaft and provided at its other end with a protuberant bell-striking portion, and a bell is provided in close adjacency to said bell-striking portion of the leaf spring.

10. The tennis game board according to claim 1, wherein the board surface gently slopes up toward the center from both opposing ends thereof where the respective racket-supporting bodies are positioned.

11. The tennis game board according to claim 1, wherein the board surface is provided with lines copying after the actual tennis court lining.

12. The tennis game board according to claim 1, wherein a net plate modelled after the actual tennis net is provided at the center of the board surface, said net plate being sufficiently spaced upwardly from the board surface to allow free passage of the ball therethrough.

13. The tennis game board according to claim 1, wherein a score indicator is provided.

* * * * *